United States Patent [19]

Marciniak et al.

[11] 4,043,173

[45] Aug. 23, 1977

[54] METHOD OF SHAPING THE OUTER SURFACES OF OBJECTS CONSISTING OF DEFORMABLE MATERIALS AND DEVICE FOR THE APPLICATION OF THE METHOD

[75] Inventors: Zdzislaw Marciniak; Mateusz Sklad; Krzysztof Chodnikiewicz, all of Warsaw, Poland

[73] Assignee: Politechnika Warszawska, Warsaw, Poland

[21] Appl. No.: 693,909

[22] Filed: June 8, 1976

Related U.S. Application Data

[63] Continuation-in-part of Ser. No. 542,831, Jan. 21, 1975, abandoned.

[30] Foreign Application Priority Data

Jan. 21, 1974 Poland ..... 168236

[51] Int. Cl.[2] ..... B21K 1/30; B21J 7/16

[52] U.S. Cl. ..... 72/403; 72/402

[58] Field of Search ..... 72/76, 285, 394, 402, 72/403, 433, 121, 465; 29/159.2

[56] References Cited

U.S. PATENT DOCUMENTS

| | | | |
|---|---|---|---|
| 3,121,352 | 2/1964 | McCardell | 29/159.2 |
| 3,281,925 | 11/1966 | Hanna | 29/159.2 |
| 3,396,563 | 8/1968 | Tlaker | 72/121 |
| 3,768,298 | 10/1973 | Jones et al. | 72/465 |

*Primary Examiner*—Lowell A. Larson

[57] ABSTRACT

A device for shaping the outer surface of a workpiece in which a sleeve is resiliently deformable in a radial direction. The sleeve is placed coaxially within a flywheel and removably fastened in a body member. A ring-shaped tool is coaxially located within the sleeve. The tool has at least five forming segments uniformly disposed on the circumference of the tool. The segments are integrally connected to one another by means of a neck portions which extend on at least one of the two axial sides of the tool. The tool is rotationally mounted in the body by means of an adjustment bushing. At least two rolls are located between the outer surfaces of the sleeve and the inner surface of the flywheel such that the rolls press the sleeve against the forming segments of the tool to deform the segments radially inwardly. The rolls are mounted in a cage which fixes their mutual angular positions.

4 Claims, 6 Drawing Figures

METHOD OF SHAPING THE OUTER SURFACES OF OBJECTS CONSISTING OF DEFORMABLE MATERIALS AND DEVICE FOR THE APPLICATION OF THE METHOD

BACKGROUND OF THE INVENTION

The present application is a continuation-in-part of the parent application, Ser. No. 542,831, filed Jan. 21, 1975 and now abandoned.

This invention relates to a method and apparatus for shaping the outer surfaces of workpieces of materials which can be deformed. The workpiece may have smooth or toothed outer surfaces, hence having the shape of cylindrical gears or bevel gears, spline shafts and the like.

Methods of shaping cross-sections of metal products by means of extrusion, push broaching and pull broaching are already known in the art. When using such methods tools are applied with inner surface being a representation of the outer surface of the product. Force is applied to the material being treated, in the axial direction, to bring about an axial displacement of the workpiece in relation to the tool. The primary advantage of apparatus for application of these methods is their simple construction. The fundamental disadvantage is that the tools come into contact with the material being treated over the whole lengths of their inner circumference. This brings about an increase in friction forces on the surfaces coming into contact with the workpiece being treated.

Devices known in the art have a flywheel comprising a tool in the form of inserts fixed on sliders of a hammer mill for hammering of metal products. The treatment takes place as a result of phase-conformable radial reciprocating movements of the sliders together with fixed tools. While the tools are out of contact with the surface of the workpiece being treated, the workpiece is shifted in the axial direction so that the surface shaping cycle is repeated in successive cross-sections of the workpiece being treated. The removal of the tools from the surface being treated improves the lubrication conditions, because the lubricant removed while a tool was in contact with the material being treated can be replaced. The number of sliders with the tool is, however, limited by constructional reasons, which renders impossible the treatment of more complex outer shapes, e.g. toothed wheels.

There is also known a device for shaping cylindrical gears by means of push broaching or pull broaching in which a massive ring-shaped tool has a profiled inner surface pressed to the surface of the workpiece being treated with radial forces. A disadvantage of this method consists in a considerable loading of the tool in which as a result of the notch effect, a dangerous concentration of stress occurs. Moreover, the massive ring, which is in fact the tool, must be sufficiently thin, due to permissible bending stresses. This does not permit use of the method for shaping bevel gears, and other workpieces having a shape differing from a cylindrical one.

There is further known a method of shaping toothed workpieces in which the surface of the workpiece being treated has pressed to its subsequent pairs of diametrically opposed forming elements. These are slidably mounted in an annular cage. The disadvantage of the method is that an even number of teeth of the wheel being shaped is necessary.

Accordingly, an object of the present invention is to provide a method in which the tools are in form of a ring for extrusion, push broaching or pull broaching of metal products. The tools have the feature of independent radial deflection of at least five parts of the circumference of a tool from the circular position. Due to this fact at the given moment in the section perpendicular to the axis, the tool has at least three parts of its inner circumference meeting at least three parts of the outer circumference of the workpiece being treated. Play is maintained between at least two remaining portions of the inner circumference of the tool and the outer circumference of the workpiece being treated.

A further object of the present invention is to provide apparatus presenting the possibility of obtaining a continuous change of the angular position of the zones of the radial deflection of the portions of the circumference of the tool in relation to the immovable axis passing through the axis of the workpiece and lying in a transverse plane which is perpendicular to the axis of the workpiece. Due to this it is possible to treat workpieces having complex outer surfaces, such as toothed wheels with odd numbers of teeth.

The lubrication conditions are improved and the dangerous bending stresses in tools are eliminated, whereby simultaneously the positive influence of the cyclic loads in the structure of the material is utilized.

SUMMARY OF THE INVENTION

According to the present invention a method is provided of shaping the outer surfaces of toothed workpieces made of material which can be deformed. An axial force is used to pull or push the workpiece in axial direction. The method comprises applying equalizing radial pressure on the outer surface by means of a ring-shaped tool having at least five forming segments mounted and arranged in such way that the forming segments are applied at least three simultaneously to a portion of the outer surface, while at least two of the remaining forming segments are withdrawn from the surface. The angular positions of the zones of the pressure in a transverse plane perpendicular to the axis of said workpiece change during the shaping process, in relation to the axis being stationary, in relation to the segments and perpendicular to said axis of the workpiece.

Also, according to the present invention, an apparatus is provided for shaping the outer surfaces of workpieces made of material which can be deformed. The apparatus has a casing, a flywheel within the casing, a ring-shaped tool mounted for rotation within the casing and being adjustable in the axial direction. The tool has many segments which are directly interconnected with one another, are firmly held each at at least one corresponding end thereof, are movable relative to one other, and, in operation of the apparatus, are adapted initially to be disposed in contact with the outer surface of the workpiece. A sleeve is secured to the inside of the casing and extending coaxially within and in radially-spaced relationship from the flywheel. The sleeve is deformable in the radial direction and encompasses the segments. At least two rolls between the inner surface of the flywheel and the outer surface of the sleeve press the sleeve on to the tool. A cage mounting the rolls determines the relative angular position thereof. The roll diameters are such relative to the annular space between the inner surface of the flywheel and the outer surface of the sleeve, that the sleeve is deformed. At least three of the segments are forced into the outer surface of the workpiece, while the remaining segments are withdrawn from the outer surface of the workpiece.

A workpiece being treated is deformed in its cross-section both in consequence of the axial force and of radial forces resulting from the action on the workpiece being treated of forming segments which at any given moment are displaced. The deflections of the individual forming segments are not equal at every moment. One or more forming segments is or are shifted to the highest degree, whereas the deflections of the neighboring forming segments are smaller down to zero. Thus, in a transverse section perpendicular to the axis of the workpiece, the workpiece being treated is contacted solely by some of the forming segments of the work device, whereas the remaining forming segments are at all times withdrawn from the circumferential surface of the workpiece being treated.

During the duration of the forming process, the greatest deflections of the forming segments change continuously their angular position in relation to the stationary axis passing through the axis of the tool and lying in a plane which is perpendicular to the axis of the tool. As a result the angular position of zones in which the tool gets into contact with the workpiece being treated, changes in a continuous manner.

The tool is placed coaxially with the flywheel and with the sleeve, and is rotationally fixed to the casing by means of an adjustment screw. That element of the apparatus which displaces the forming segments is a resilient sleeve which is disconnectably fastened in the casing and within which the tool is coaxially disposed. The tool is displaced in the radial direction with the aid of several rolls, placed in a cage determining their mutual angular positions. The rolls exert a pressure on the outer surface of the sleeve. At each cross-section of the sleeve, the distance from the axis of the sleeve, of the point at which each roll gets into contact with the sleeve, is smaller than the radius of the outer surface of the non-deformed sleeve.

The rolls roll on the outer surface of the sleeve. As a result there is obtained a continuous change of the angular position of the zones of maximum radial displacement of the forming segments of the tool. The rolls are driven through the flywheel the inner surface of which, rolls about the rolls.

An advantage of the invention is that, due to the application of the tool whose forming segments are able to move in the radial direction independently of one another, it is easy to exert a local radial pressure on the workpiece being treated. This offers facilities for deforming the material of the workpiece in the radial direction and makes it possible to obtain surface deformations, while maintaining the core of the material being treated in a non-plasticized state. At the same time, due to the repeated deflections of the given zone of the circumference of the work device, thereby bringing about repeated application of pressure to the given zone of the workpiece being treated, good use is made of the positive influence exerted by the repeated loads on the plastic deformation process.

The method according to the invention as well as the apparatus for putting the method into effect, when shaping the outer surface of workpieces, make it possible to execute inner shapes in the workpieces as a result of the swaging of the treated material on a core inserted beforehand into an opening in the workpiece.

BRIEF DESCRIPTION OF THE DRAWING

Embodiments of the invention will now be described, by way of example, with reference to the accompanying drawings, in which.

Similar reference numerals denote like parts throughout the drawings.

DESCRIPTION OF THE PREFERRED EMBODIMENT

Figure 1:
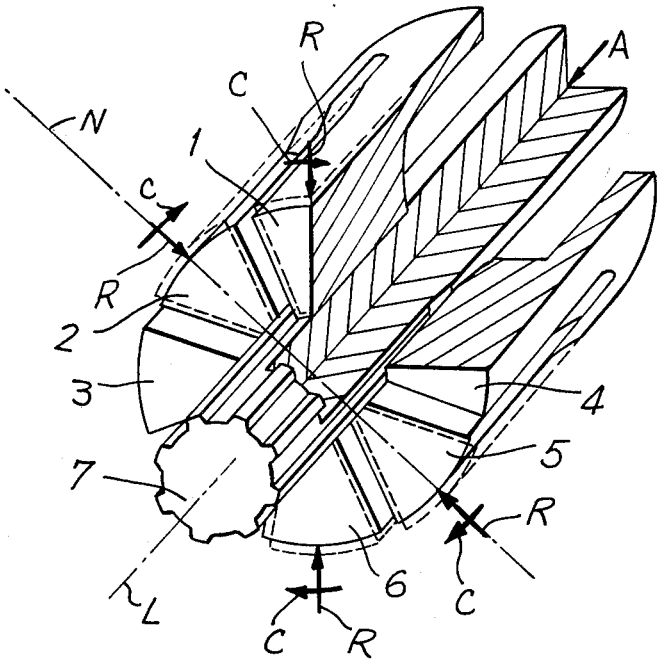
FIG. 1 is perspective view partly in section, illustrating construction of tool having several segments for shaping the outer surface of an object made of a material susceptible to deformation.

Referring firstly to FIG. 1, the tool is cylindrical and includes an annular series of forming segments 1, 2, 3, 4, 5, and 6, integrally joined with one another at one end of the tool. The workpiece 7 is deformed as a result of the application of force axially thereof and forces radially thereof as indicated by the arrows A and R, respectively. The radial forces change their angular positions in accordance with the direction indicated by the arrows C, in relation to the stationary axis N passing through the axis L of the workpiece 7 and lying in a transverse plane which is perpendicular to the axis L. Those segments, 3 and 4, of the tool which, at the instance illustrated in FIG. 1, are not charged with radial forces, are out of contact with the workpiece 7. Segments 1, 2, 5 and 6 are pressed with radial forces down to the surface of the workpiece 7.

Figure 2:
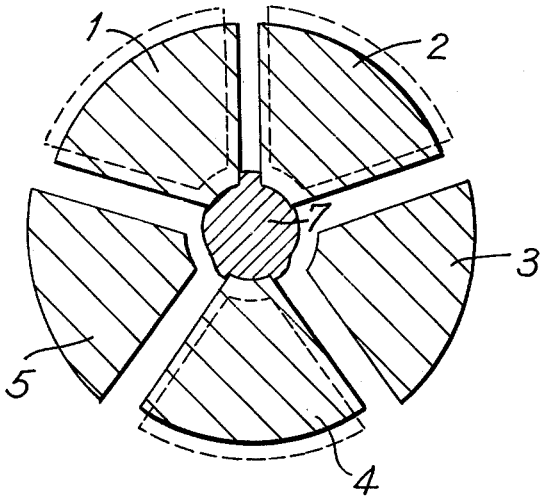
FIGS. 2 and 3 illustrate the subsequent phases of the cycle of shaping the surface of the workpiece in given cross-section perpendicular to the axis.

In FIG. 2, the equalizing radial pressures on the workpiece 7 are exerted by means of three segments 1, 2 and 4 displaced in radial directions from their circular position. The segments 3 and 5 are withdrawn from the surface of the workpiece and rest in their initial circular position.

Figure 3:
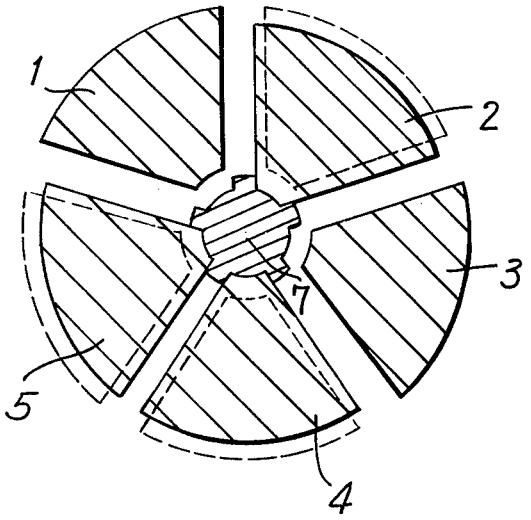

In FIG. 3 which shows the next instance of the process, the equalizing radial pressures onto the workpiece 7 are exerted by means of segments 2, 4 and 5 and the remaining segments 1 and 3 are withdrawn from the surface of the workpiece 7 and occupy their initial circular position.

Figure 4:
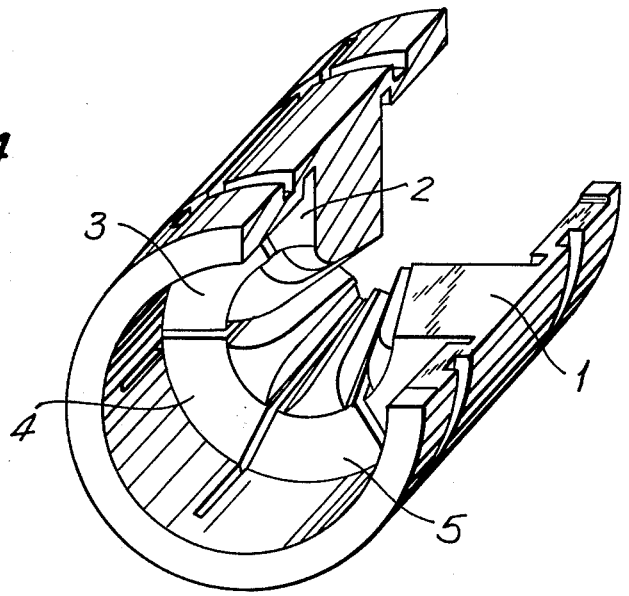
FIG. 4 is perspective view partly in section, illustrating the modified construction of the tool.

In FIG. 4 the series of forming segments 1, 2, 3, 4, and 5 of the tool are integrally joined with one another at two ends of the tool.

Figure 5:
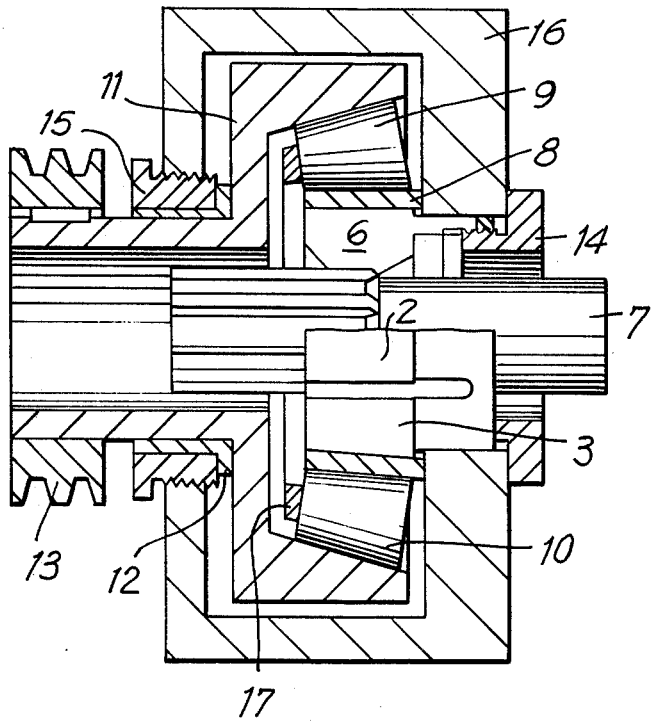
FIG. 5 is a longitudinal section through apparatus according to the invention.
Figure 6:
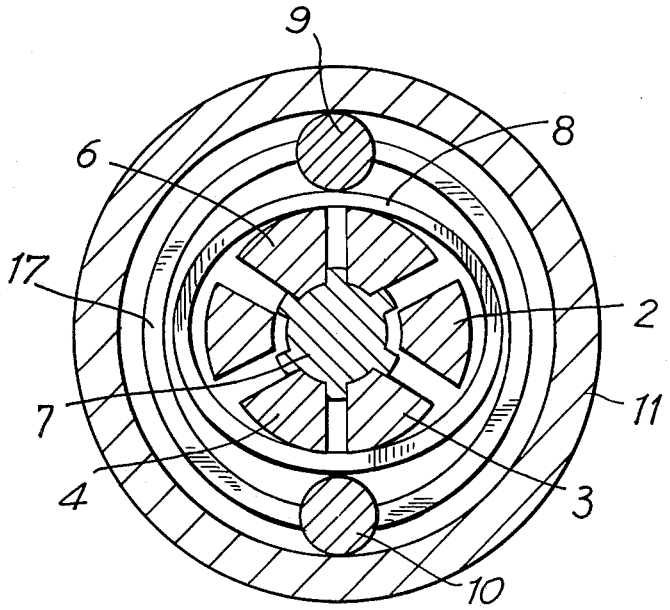
FIG. 6 is a transverse section through the apparatus of FIG. 5.

The apparatus illustrated in FIGS. 5 and 6 includes a frusto-conical sleeve 8 within which the forming segments 1, 2, 3, 4, 5 and 6 of the tool are located. The sleeve 8 is deflected radially in relation to the axis of the workpiece 7 by conical rolls 9 and 10 mounted in a cage 17 and rolling on the frusto-conical surface of the sleeve. The rolls 9 and 10 are driven by a flywheel 11 mounted in a bearing 12. The flywheel is driven by a belt transmission with the aid of a belt pulley 13. An adjustment screw 14 securing the tool within a surrounding casing 16 for rotation relative to the body, and an adjustment screw 15 mounted on the bearing 12 and in the casing 16, are intended for regulating the magnitude of the radial deflection of the forming segments 1, 2, 3, 4, 5 and 6 of the work device.

The apparatus according to the invention operates in the following manner: The flywheel 11, when turning, deforms the sleeve 8 through the agency of the rolls 9 and 10 mounted in the cage 17 determining their angular position. The sleeve 8 then assumes an oval shape in transverse section (see FIG. 5). As the flywheel 11 rotates, the angular position of the major axis and of the minor axis of the oval changes in accordance with the direction of rotation of the flywheel 11, and this causes the forming segments 1, 2, 3, 4, 5 and 6 of the tools to be shifted repeatedly to and from the workpiece 7 which is simultaneously shifted in the axial direction. The combination of the movements of the forming segments 1, 2, 3, 4, 5 and 6 of the tool and of the workpiece 7 results in convenient shaping of the outer surface of the workpiece 7. The magnitude of the radial deflection of the forming segments 1, 2, 3, 4, 5 and 6 of the tool is adjustable by turning the adjustment screws 14 and 15.

The apparatus is also intended for plastic treating of non-metallic materials capable of being plastically shaped.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention, and therefore, such adaptations should and are intended to be comprehended within the meaning and range of equivalence of the following claims.

We claim:

1. A method of shaping the outer surface of a workpiece of a material which can be deformed, by using an axial force to pull or push said workpiece with a profile having a form complementary to that of the workpiece profile, comprising the steps of exerting equalizing radial pressure on said outer surface with a ring-shaped tool having at least five independently movable segments mounted in a predetermined arrangement, said segments being sectors of a ring; applying said segments at least three at a time to a part of said outer surface while at least two of the remaining segments are withdrawn from said outer surface; and changing during the shaping process the angular positions of the zones of greatest pressure, in a transverse plane perpendicular to the axis of said workpiece, in relation to an axis which is stationary and is perpendicular to said axis of said workpiece, said tool performing independent movements of selected portions of its surface.

2. Apparatus for shaping the outer surface of a workpiece of a material which can be deformed, comprising a casing; a flywheel within said casing; a ring-shaped tool mounted within said casing and being adjustable in the axial direction, said tool having a plurality of forming segments interconnected directly with one another, said segments being firmly held at at least one corresponding end thereof, said segments being movable relative to one another in the radial direction, said segments being in the operative state initially in contact with said outer surface of said workpiece; a sleeve secured to the inside of said casing and extending coaxially within and in radially-spaced relationship from said flywheel, said sleeve being resiliently deformable in the radial direction and encompassing said segments; at least two rolls between the inner surface of said flywheel and the outer surface of said sleeve and pressing said sleeve onto said tool; and a cage mounting said rolls and determining the relative angular positions thereof, the roll diameters being relative to the annular space between said inner surface of said flywheel and said outer surface of said sleeve so that said sleeve is deformed and at least three of said segments are forced against said outer surface of said workpiece while the remaining said segments are with drawn from said outer surface of said workpiece.

3. Apparatus as claimed in claim 2, wherein radially inner surface of each of said segments of said ring-shaped tool complements a portion of said outer surface of said cylindrical workpiece.

4. Apparatus as claimed in claim 2 wherein said plurality of forming segments comprises at least five segments.

* * * * *